US009752421B2

(12) United States Patent
LaGrange et al.

(10) Patent No.: US 9,752,421 B2
(45) Date of Patent: Sep. 5, 2017

(54) PRESSURE SWITCH FOR SELECTIVE FIRING OF PERFORATING GUNS

(71) Applicant: OWEN OIL TOOLS LP, Houston, TX (US)

(72) Inventors: Timothy E. LaGrange, Rainbow, TX (US); Cory D. Day, Burleson, TX (US); George Patton, Benbrook, TX (US); Dan W. Pratt, Benbrook, TX (US); Bradley Vass, Fort Worth, TX (US)

(73) Assignee: OWEN OIL TOOLS LP, Houston, TX (US)

( * ) Notice: Subject to any disclaimer, the term of this patent is extended or adjusted under 35 U.S.C. 154(b) by 0 days.

(21) Appl. No.: 15/008,061

(22) Filed: Jan. 27, 2016

(65) Prior Publication Data

US 2016/0215597 A1 Jul. 28, 2016

Related U.S. Application Data

(60) Provisional application No. 62/108,768, filed on Jan. 28, 2015.

(51) Int. Cl.
*E21B 43/1185* (2006.01)

(52) U.S. Cl.
CPC .... *E21B 43/1185* (2013.01); *E21B 43/11852* (2013.01)

(58) Field of Classification Search
CPC ..... E21B 43/1185–43/11852; E21B 43/11855
See application file for complete search history.

(56) References Cited

U.S. PATENT DOCUMENTS

| | | | |
|---|---|---|---|
| 3,246,707 | A | 4/1966 | Bell |
| 3,246,708 | A | 4/1966 | Harrigan, Jr. et al. |
| 3,648,785 | A | 3/1972 | Walker |
| 4,234,768 | A | 11/1980 | Boop |

(Continued)

FOREIGN PATENT DOCUMENTS

GB 2054107 A 2/1981

OTHER PUBLICATIONS

PCT/US2016/015320—International Search Report dated Jun. 9, 2016.

*Primary Examiner* — Stephen M Johnson
*Assistant Examiner* — Joshua Semick
(74) *Attorney, Agent, or Firm* — Mossman, Kumar & Tyler, PC

(57) ABSTRACT

A switch includes a casing having a bore, a piston assembly having a first end and an exposed end, a plurality of flanges formed at the first end; an insulating sleeve enclosing the first end, a contact assembly disposed in the casing bore; a pin disposed in the bore; a predetermined quantity of lubricant deposited in the bore; and a spring urging the pin into engagement with the piston assembly. The insulating sleeve and the plurality of flanges are at least partially disposed in the casing bore. The pin has: (i) a first position wherein the pin electrically contacts the piston assembly and is electrically isolated from the contact assembly; and (ii) a second position wherein the pin is electrically isolated from the piston assembly and electrically engages the contact assembly. The predetermined quantity of lubricant may be approximately 0.3 grams.

8 Claims, 2 Drawing Sheets

(56) References Cited

U.S. PATENT DOCUMENTS

| | | | | | |
|---|---|---|---|---|---|
| 4,266,613 | A * | 5/1981 | Boop | F42D 1/04 | 166/299 |
| 4,306,628 | A * | 12/1981 | Adams, Jr. | F42D 1/04 | 102/301 |
| 4,457,383 | A * | 7/1984 | Boop | E21B 43/1185 | 175/4.55 |
| 5,287,924 | A | 2/1994 | Burleson et al. | | |
| 5,346,014 | A * | 9/1994 | Ross | E21B 23/065 | 102/201 |
| 5,483,895 | A * | 1/1996 | Tomek | F42D 1/04 | 102/251 |
| 5,603,384 | A | 2/1997 | Bethel et al. | | |
| 5,911,277 | A * | 6/1999 | Hromas | E21B 43/11852 | 166/297 |
| 6,035,880 | A * | 3/2000 | Gazda | E21B 21/103 | 137/68.16 |
| 7,902,469 | B2 | 3/2011 | Hurst | | |
| 8,710,385 | B2 * | 4/2014 | Sickels | F42D 1/045 | 200/82 R |
| 8,851,160 | B2 * | 10/2014 | Stolboushkin | E21B 43/11855 | 166/55 |
| 8,967,291 | B2 | 3/2015 | Bonavides et al. | | |
| 8,991,496 | B2 * | 3/2015 | Bishop | E21B 43/11852 | 166/298 |
| 9,194,219 | B1 | 11/2015 | Hardesty et al. | | |
| 9,291,040 | B1 * | 3/2016 | Hardesty | F42D 1/04 | |
| 2010/0126370 | A1 * | 5/2010 | O'Dwyer | F42B 5/035 | 102/438 |
| 2014/0318766 | A1 | 10/2014 | Bishop | | |

* cited by examiner

PRESSURE SWITCH FOR SELECTIVE FIRING OF PERFORATING GUNS

CROSS REFERENCE TO RELATED APPLICATIONS

This application claims priority from U.S. Provisional Application Ser. No. 62/108,768 filed on Jan. 28, 2015, the entire disclosure of which is incorporated herein by reference in its entirety.

TECHNICAL FIELD

The present disclosure relates to devices and methods for selective firing of perforating guns.

BACKGROUND

One of the activities associated with the completion of an oil or gas well is the perforation of a well casing. During this procedure, perforations, such as passages or holes, are formed in the casing of the well to enable fluid communication between the well bore and the hydrocarbon producing formation that is intersected by the well. These perforations are usually made with a perforating gun loaded with shaped charges. The gun is lowered into the wellbore on electric wireline, slickline or coiled tubing, or other means until it is adjacent the hydrocarbon producing formation. Thereafter, a surface signal actuates a firing head associated with the perforating gun, which then detonates the shaped charges. Projectiles or jets formed by the explosion of the shaped charges penetrate the casing to thereby allow formation fluids to flow from the formation through the perforations and into the production string for flowing to the surface.

In some situations, a gun train having a series of guns is successively fired. These configurations typically include devices for selectively arming such guns. The present disclosure relates to methods and devices for selective arming of guns in a gun train.

SUMMARY

In aspects, the present disclosure provides a switch for selectively firing a perforating gun train that includes at least a first perforating gun and a second perforating gun. The switch may include a casing having a bore, a piston assembly, a contact assembly disposed in the casing bore, a pin disposed in the bore, a predetermined quantity of lubricant deposited in the bore, and a spring. The piston assembly may have a first end and an exposed end, a plurality of flanges formed at the first end, a plurality of grooves formed at the exposed end, an insulating sleeve enclosing the plurality of flanges and electrically isolating the piston assembly from the casing. The insulating sleeve and the plurality of flanges may be at least partially disposed in the casing bore. The pin may be slidable between a first position and a second position. The pin electrically contacts the piston assembly and is electrically isolated from the contact assembly in the first position, and the pin is electrically isolated from the piston assembly and electrically engages the contact assembly in the second position. The spring may urge the pin into engagement with the piston assembly when the pin is in the first position. The predetermined quantity of lubricant may be approximately 0.3 grams.

In aspects, the present disclosure provides a method for selectively firing a perforating gun train. The method may include forming the perforating gun train to include includes at least a first perforating gun and a second perforating gun, forming an electrical connection between the perforating gun train and a surface location using at least one switch as described above; conveying the perforating gun train into a wellbore with the pin in the first position; firing the first perforating gun, the firing causing the pin to move to the second position; and firing the second gun.

It should be understood that certain features of the disclosure have been summarized rather broadly in order that the detailed description thereof that follows may be better understood, and in order that the contributions to the art may be appreciated. There are, of course, additional features of the disclosure that will be described hereinafter and which will in some cases form the subject of the claims appended thereto.

BRIEF DESCRIPTION OF THE DRAWINGS

For detailed understanding of the present disclosure, references should be made to the following detailed description taken in conjunction with the accompanying drawings, in which like elements have been given like numerals and wherein.

DETAILED DESCRIPTION

Figure 1:
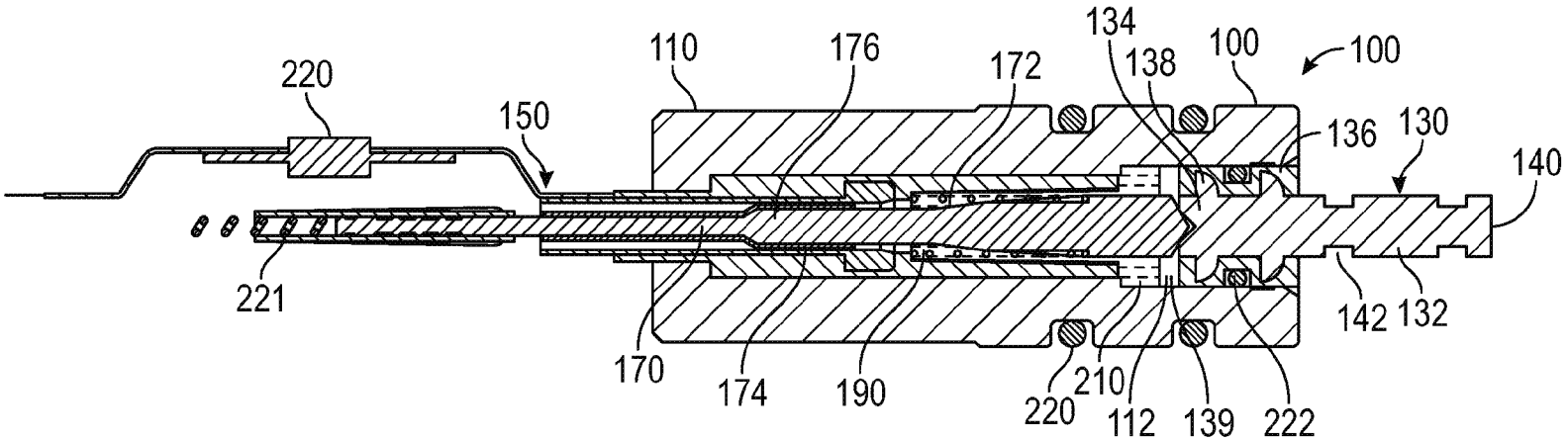
FIG. 1 schematically illustrates a side sectional view of a pre-activated switch according to one embodiment of the present disclosure.

The present disclosure relates to devices and methods for preventing an unintended activation of one or more downhole tools. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

Referring to FIG. 1, there is schematically illustrated one embodiment of a switch 100 made in accordance with the present disclosure. The switch 100 includes a casing 110, an electrically conductive piston assembly 130, a contact assembly 150, an electrically conductive pin 170, a spring 190, and a lubricant 210. The switch 100 may be configured to actuate any desired device. One non-limiting device is an electrical device that may be used to change the polarity of current that passes through a circuit. Such devices include, but are not limited to, a diode assembly 220. Sealing elements 220 form fluid barriers between the casing 110 and adjacent structures and sealing elements 222 may be used to provide fluid isolation for the interior of the casing 110.

The casing 110 may be a tubular body having a bore 112 for receiving the piston assembly 130 and the contact assembly 150. The lubricant 210 may be deposited in the bore 112 and proximately at the region wherein the piston assembly 130 and the contact assembly 150 face one another.

The piston assembly 130 includes a piston body 132 having a first end 134 that is enclosed by an electrically insulating sleeve 136. In one arrangement, the first end 134 includes a plurality of flanges 138 (e.g., two flanges). The flanges 138 are circumferential projections such as a rib that has surfaces oriented transverse to a circumferential surface of the piston body 132. These transverse surfaces ensure the detonation impact that is applied to the piston body 132 is distributed over a large amount of shear area when the insulating sleeve 136 applies pressure to the lubricant 210. Such an arrangement reduces the risk that the piston body 132 does not shear through the insulating sleeve 136 when gun detonation pressure is applied and charge debris impacts an exposed end 140 of the piston body 132. Such an arrangement may also increase the pressure rating to at least 20,000 psi (after gun detonation). In another arrangement (not shown), one flange is used and the flange is positioned on isolated bore side 139 of the sealing element 222. In some embodiments, the piston body 132 may include two or more grooves 142 formed at the exposed end 140. The most distal groove may be used to connect a wire (not shown). The interior groove reduces the cross section of the piston body 132 such that the piston body 132 can bend and break, which may protect the piston seal area at the insulating sleeve 136 from damage.

The contact assembly 150 selectively forms an electrical path when the circuit is completed by the pin 170. That is, the contact assembly 150 may have to conductors, here concentrically arranged, that are electrically isolated. The pin 170 upon entering the contact assembly 150 forms an electrical connection between these two conductors. The contact assembly 150 may have suitable connection points at which electrical leads may be connected. The contact assembly 150 may also include suitable bores or cavities to receive the pin 170 and the spring 190.

The lubricant 210 is a pressure transmitting fluid body that transfers pressure applied by the piston body 132 to the pin 170. In one non-limiting arrangement, the lubricant 210 may be grease. The amount of lubricant may be 0.3 grams. If less lubricant is used, the force applied to the pin 170 may not be sufficient to fully seat the pin 170 into the contact assembly 150 and maintain electrical conductivity. If more lubricant is used, the impact force may be reduced, which may result in inadequate seating of the pin 170 into the contact assembly 150.

The pin 170 slides axially away from the piston assembly 130 toward the contact assembly 150 when sufficient pressure is supplied by the lubricant 210. In one embodiment, the pin 170 may be a rod-like member having a tapered seat 172 that is shaped to ensure an inner diameter of the spring 190 does not bind on the pin 170 when the pin 170 is seating into the contact assembly 150. Further, the outer surfaces of the pin 170 are substantially free of sharp shoulders or projections that the inner diameter of the spring 190 can bind upon as the pin 170 enters the contact assembly 150. In embodiments, the pin 170 may include one or more ridges 174 in an upper end 176 to provide a shoulder on which a wire and solder interface (not shown) may adhere. This configuration also provides increased shear area of the solder to reduce the chances of the wire/solder interface breaking loose from the pin 170 when the perforating gun (not shown) is detonated.

In the pre-activated position of FIG. 1, a wire (not shown) from a detonator (not shown) of a downhole perforating gun (not shown) is connected at the outermost groove 142 of the piston body 132, the piston body 132 and the pin 170 are in physical contact with one another, and another wire (not shown) in electrical communication with a firing panel (not shown) at the surface is connected to the pin 170. Thus, electrical signals travel via the pin 170 and the piston body 132 to the downhole detonator (not shown). The contact assembly 150 is not part of this circuit.

Figure 2:
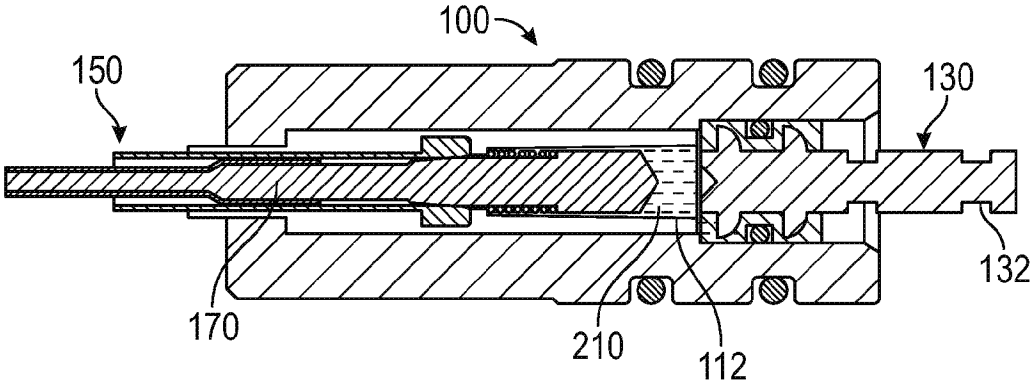
FIG. 2 schematically illustrates the FIG. 1 embodiment after being activated.

After detonation, the switch 100 has the configuration shown in FIG. 2. The pressure generated by the firing of the downhole perforating gun (not shown) displaces the piston assembly 130 toward the pin 170. The piston assembly 130 reduces a volume of the bore 112, which pressurizes the lubricant 210. The pressurized lubricant 210 flows along the bore and toward the pin 170 and applies a pressure to the pin 170, which displaces the pin 170 into the contact assembly 150. Thus, the pin 170 is no longer in electrical communication with the piston assembly 130. Instead, the pin 170 is driven into the contact assembly 150 and wedges into a fixed relationship with the contact assembly 150. The engagement between the pin 170 and the contact assembly 150 forms an electrical path 221 (FIG. 1) from the surface to the detonator or other equipment of the uphole perforating gun (not shown). This electrical path may include the electrical equipment such as a diode assembly that allows selective transmission of DC electrical power. The pressure of the lubricant 210 overcomes the spring force of the spring 190 and effectively locks the spring 170 with the contact assembly 150.

Figure 3:
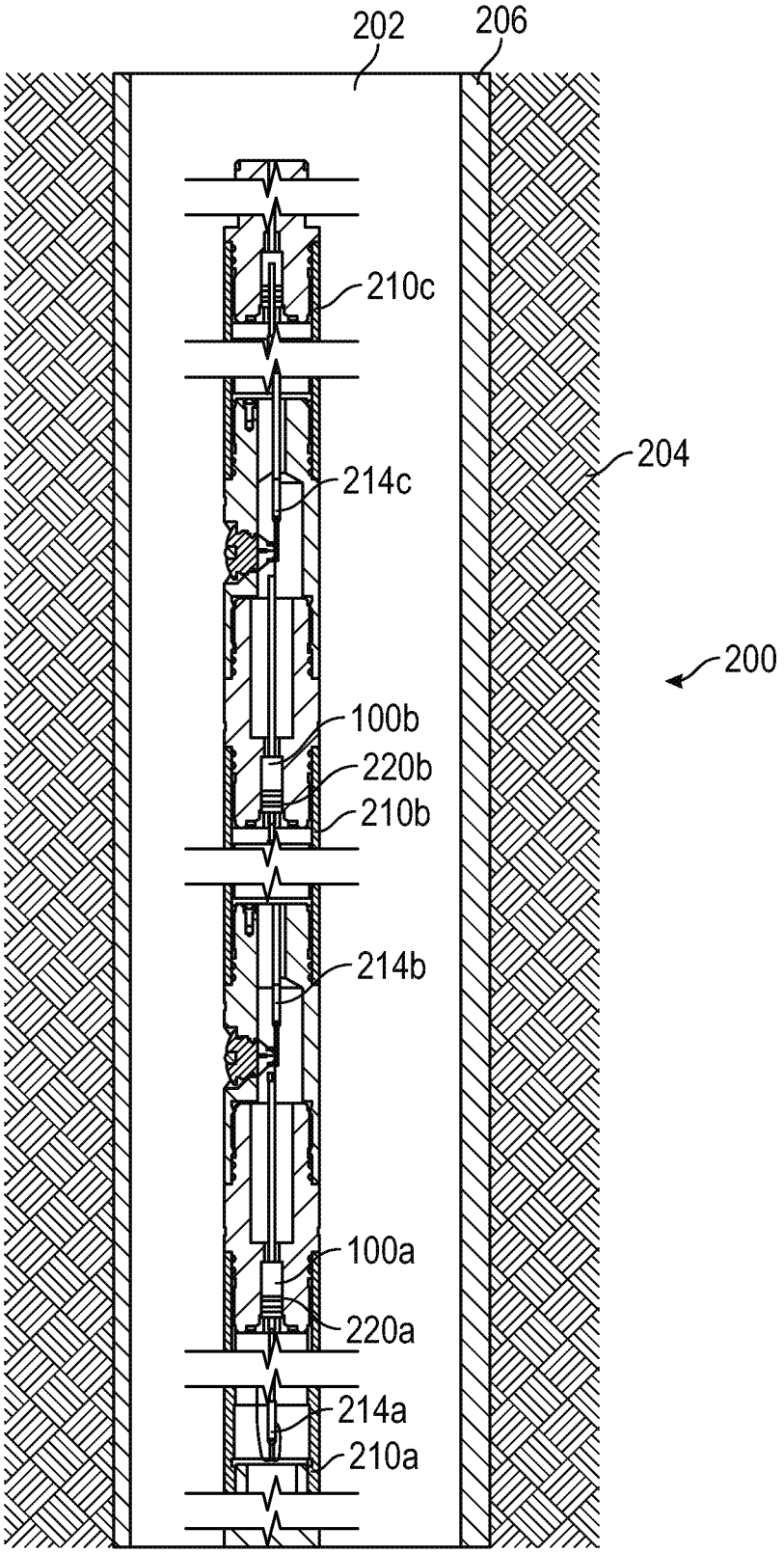
FIG. 3 schematically illustrates a perforating gun assembly that incorporates switches according to the present disclosure.

Referring to FIG. 3, there is shown an illustrative use of a switch 100 according to the present disclosure. In FIG. 3, there is shown a section of a perforating gun assembly 200 in a wellbore 202 drilled in an earthen formation 204. The wellbore 202 may include a wellbore tubular such as a casing 206. The perforating gun assembly 200 may include a plurality of perforating guns 210*a,b,c*. In one arrangement, the perforating gun assembly includes two switches 100*a,b*, each of which have an associated diode assembly 220*a,b*, respectively. A lower switch 100*a* is configured to pass only negative polarity DC current after activation. An upper switch 100*b* is configured to pass only positive polarity DC current activation. A detonator 214*a* is configured to detonate the perforating gun 210*a*, a detonator 214*b* is configured to detonate the perforating gun 210*b*, and a detonator 214*c* is configured to detonate the perforating gun 210*c*.

During use, the perforating gun assembly 200 is placed at a desired depth and the operator applies a positive DC current at a surface shooting panel (not shown) to fire the lowermost perforating gun 210*a*. The current flows through the detonator 214*a* and thereby fires the bottom perforating gun 210*a*. The pressure pulse associated with the firing of the bottom perforating gun 210*a* actuates the lower switch 100*a*. This actuation causes an associated diode assembly 220*a* to block positive DC current. Because the diode assembly 220*a* on the first switch 100*a* blocks positive DC current, current does not reach the detonator 214*b* and the second perforating gun 210*b* does not fire at this time.

When the operator is ready to fire the second perforating gun 210*b*, a negative DC current is be applied at the shooting panel (not shown). The negative DC current is allowed to pass through the diode on the switch 100*a* and the detonator 214*b* detonates, which fires the second perforating gun 210*b*. As a result, the pin on the upper switch 100*b* is pushed up, which actuates activates the upper switch 100*b*. This actuation causes an associated diode assembly 220*b* to block negative DC current. Because the diode assembly 220*a* on the first switch 100*a* blocks negative DC current, the diode assembly 220*b* on the upper switch 100*b* blocks negative DC current, which prevents current reaching the detonator 214*c* and does not cause the third perforating gun 210*c* to fire.

When the operator is ready to fire the third gun 210*c*, a positive DC current is applied at the shooting panel. The positive DC current is allowed to pass through the diode on the switch 100*b* and the detonator 214*c* detonates, which fires the third perforating gun 210*c*.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. It is intended that the following claims be interpreted to embrace all such modifications and changes.

What is claimed is:

1. A switch for selectively firing a perforating gun train that includes at least a first perforating gun and a second perforating gun, comprising:

a casing having a bore;

a piston assembly having an outer circumferential surface, a first end and an exposed end, a plurality of flanges formed at the first end and projecting radially outward from the outer circumferential surface, a plurality of grooves formed at the exposed end and recessed radially from the outer circumferential surface, an insulating sleeve enclosing the plurality of flanges and electrically isolating the piston assembly from the casing, wherein the insulating sleeve and the plurality of flanges are at least partially disposed in the casing bore;

a contact assembly disposed in the bore;

a pin disposed in the bore, the pin being slidable between a first position and a second position, wherein the pin electrically contacts the piston assembly and is electrically isolated from the contact assembly in the first position, and the pin is electrically isolated from the piston assembly and electrically engages the contact assembly in the second position, wherein the pin and piston assembly define a volume in the bore;

a lubricant deposited in the bore, the lubricant forming a pressure transmitting body between the pin and the piston assembly as the pin slides from the first position to the second position, wherein the pressure transmitting body completely fills the volume defined by the pin and the piston assembly when the pin is in the second position; and a spring urging the pin into engagement with the piston assembly when the pin is in the first position, wherein the pin moves from the first position to the second position in response to a pressure applied by the pressure transmitting body, and wherein the lubricant completely filling the volume defined by the pin and the piston assembly overcomes a spring force of the spring and locks the pin with the contact assembly when the pin is in the second position.

2. The switch of claim 1, wherein the lubricant is in an amount of approximately 0.3 grams.

3. The switch of claim 1, wherein the lubricant is deposited in the bore and proximately at the region wherein the piston assembly and the pin face one another.

4. The switch of claim 1, wherein the piston assembly includes a piston body on which the outer circumferential surface is formed, and wherein each flange of the plurality of flanges is circumferential projection that has surfaces oriented transverse to a circumferential surface of the piston body.

5. The switch of claim 1, wherein the spring surrounds a tapered portion of the pin.

6. The switch of claim 1, wherein the contact assembly includes a bore in which the spring is received.

7. The switch of claim 1, wherein:

the lubricant is deposited in the bore and proximately at the region wherein the piston assembly and the contact assembly face one another;

the piston assembly includes a piston body and wherein each flange of the plurality of flanges is circumferential projection that has surfaces oriented transverse to a circumferential surface of the piston body;

the spring surrounds a tapered portion of the pin;

and the contact assembly includes a bore in which the spring is received.

8. A method for selectively firing a perforating gun train, comprising:

forming the perforating gun train to include includes at least a first perforating gun and a second perforating gun, forming an electrical connection between the perforating gun train and a surface location using at least one switch, wherein the switch includes:

a casing having a bore;

a piston assembly having an outer circumferential surface, a first end and an exposed end, a plurality of flanges formed at the first end and projecting radially outward from the outer circumferential surface, a plurality of grooves formed at the exposed end and recessed radially from the outer circumferential surface;

a contact assembly disposed in the bore;

a pin disposed in the bore, the pin being slidable between a first position and a second position, wherein the pin electrically contacts the piston assembly and is electrically isolated from the contact assembly in the first position, and the pin is electrically isolated from the piston assembly and electrically engages the contact assembly in the second position, wherein the pin and piston assembly define a volume in the bore;

a lubricant deposited in the bore, the lubricant forming a pressure transmitting body between the pin and the piston assembly as the pin slides from the first position to the second position, wherein the pressure transmitting body completely fills the volume defined by the pin and the piston assembly when the pin is in the second position; and a spring urging the pin into engagement with the piston assembly when the pin is in the first position;

conveying the perforating gun train into a wellbore with the pin in the first position;

firing the first perforating gun, the firing causing the pressure transmitting body to apply a pressure to move the pin to the second position;

locking the pin with the contact assembly when the pin is in the second position using the lubricant, the lubricant completely filling the volume defined by the pin and the piston assembly; and firing the second gun.

* * * * *